US005924179A

United States Patent [19]

Groshens

[11] Patent Number: 5,924,179

[45] Date of Patent: Jul. 20, 1999

[54] METHOD OF TREATING A TEXTILE BASE MATERIAL FOR THERMO-BONDING INTERLINING BASED ON TEXTURIZED THREADS

[75] Inventor: Pierrot Groshens, Peronne, France

[73] Assignee: Lainiere de Picardie S.A., Peronne Cedex, France

[21] Appl. No.: 08/861,125

[22] Filed: May 21, 1997

[30] Foreign Application Priority Data

May 29, 1996 [FR] France ..... 96 06832

[51] Int. Cl.[6] ..... B05D 5/00; D04B 9/00; D04B 9/04; D04B 11/00

[52] U.S. Cl. ..... 26/28; 26/3; 427/207.1; 427/208.2; 427/288

[58] Field of Search ..... 156/148, 291, 156/153, 272.2, 88; 427/207.1, 208.2, 208.6, 288; 26/3, 6, 8 R, 15 R, 27, 28, 29 R

[56] References Cited

U.S. PATENT DOCUMENTS

| | | | |
|---|---|---|---|
| 3,837,051 | 9/1974 | Osthoff et al. . | |
| 4,731,274 | 3/1988 | Ishida et al. | 427/208.2 |
| 5,050,280 | 9/1991 | Hartkorn et al. | 26/28 |
| 5,350,626 | 9/1994 | Gorshens et al. . | |
| 5,593,533 | 1/1997 | Groshens | 156/148 |
| 5,688,558 | 11/1997 | Groshens | 427/208.2 |

FOREIGN PATENT DOCUMENTS

| | | |
|---|---|---|
| 0578527 A1 | 1/1994 | European Pat. Off. . |
| 644287 | 3/1995 | European Pat. Off. . |
| 2176941 | 11/1973 | France . |

*Primary Examiner*—Steven D. Maki
*Attorney, Agent, or Firm*—Wolf, Greenfield & Sacks, P.C.

[57] ABSTRACT

A method of the invention relates to treating a textile base material for thermobonding interlining, the material being constituted by a woven fabric or a weft knit that includes texturized synthetic threads, in particular air jet texturized threads, which form loops on a top face that is to receive spots of glue, and on an opposite, bottom face. The method consists in subjecting said textile base material, prior to applying spots of glue thereto, to emerizing or equivalent pre-treatment on its bottom face and to pre-treatment on its top face for reducing the height of the loops, e.g. singeing or heat treatment by radiation or by contact. Preferably, the textile base material is initially subjected to emerizing or equivalent pre-treatment on its bottom face, and subsequently to singeing pre-treatment on its top face.

15 Claims, 1 Drawing Sheet

METHOD OF TREATING A TEXTILE BASE MATERIAL FOR THERMO-BONDING INTERLINING BASED ON TEXTURIZED THREADS

The present invention relates to the field of providing garments with interlining, in particular thermobonding interlining comprising a textile base material having deposits of thermofusible polymers on one of its faces. The invention relates more particularly to a method of treating a textile base material for thermobonding interlining and made of threads that are texturized, in particular by jets of air.

BACKGROUND OF THE INVENTION

Materials for thermobonding interlining include both woven and non-woven textile base materials. Woven materials proper are obtained by weaving or knitting threads, whereas non-woven materials are obtained by making up and then consolidating a web of threads or filaments.

To make a textile base material for interlining purposes, use has already been made of texturized synthetic threads, obtained either by the method of fixed false twisting or by the air jet texturizing technique.

In the particular technique of air jet texturizing, a first thread known as a "core" thread and a second thread known as an "effect" thread penetrate together into a texturizing nozzle with the effect thread being fed in faster than the core thread. The texturizing nozzle includes an internal chamber fed with a flow of compressed air suitable for establishing turbulence that tangles the filaments constituting the core thread and the effect thread in such a manner as to form loops of effect thread filaments which are inserted between and locked by the filaments of the core thread.

The use of that technique to produce a textile base material having good covering power, as can be obtained by a non-woven fabric, and good bulking, is already known from the Applicant's document EP 578 527.

Unfortunately, a difficulty appears when implementing thermobonding interlining in which the texturized threads form loops projecting from both faces. This difficulty appears during the various operations included in preparing thermobonding interlining pieces for making up the corresponding garments. These operations include in particular presenting the textile base material in the form of a stack or "lay-up" which consists in superposing a plurality of layers made up of the textile base material for thermobonding interlining, and then cutting the stack formed and compacted in this way so as to obtain a plurality of pieces for thermobonding interlining that are of determined shape. This plurality of pieces, while still in the form of a superposed and compacted stack, is forwarded to a subsequent manufacturing station where each thermobonding interlining piece is taken individually from said stack.

As a general rule, the initial laying up of a wide textile base material is achieved by forming successive superposed folds. This technique means that it is always the same faces that are face-to-face in successive folds. In other words, in any given fold, the face of the textile base material that includes the thermofusible polymer deposit is facing, and thus in contact with, the face of an adjacent fold that likewise includes thermofusible polymer deposit. The same applies to the opposite faces which similarly face one another and are in contact.

The Applicant has observed that when thermobonding interlining is performed with a textile base material made up of a woven fabric or of a weft knit, and including synthetic threads that have been texturized, in particular by jets of air, thereby forming loops that project from the top face having the spots of glue and also from the opposite bottom face, catching phenomena can occur, such that when individual thermobonding interlining pieces are taken from a stack that has been cut up, the catching phenomenon makes it difficult to take only one individual piece from the stack.

OBJECT AND SUMMARY OF THE INVENTION

The object of the Applicant is to avoid those catching phenomena when taking individual pieces for thermobonding interlining from a cut-up stack.

This object is achieved by a method of treating a textile base material for thermobonding interlining, the material being constituted by a woven fabric or a weft knit that includes texturized synthetic threads, in particular air jet texturized threads, which threads form loops on a top face that is to receive spots of glue, and on an opposite, bottom face.

In characteristic manner, the method of the invention consists in subjecting said textile base material, prior to applying spots of glue thereto, to emerizing or equivalent pre-treatment on its bottom face, and to pre-treatment on its top face for reducing the height of the loops.

These two pre-treatments, performed on each of the faces of the textile base material, prior to applying deposits of thermofusible polymer, reduce considerably or even eliminate phenomena of catching between opposite faces in the cut-up stack.

The same improvement is observed when the stack is laid up by merely superposing layers without forming folds, such that the top face of any given layer faces, and is in contact with, the bottom face of an adjacent layer.

Preferably, the pre-treatment for reducing the height of the loops on the top face is a singeing treatment, i.e. treatment in which the top face is subjected to the action of a flame formed from a gas burner strip, extending transversely to the travel direction of the material.

This singeing gives rise to a localized thermal shock on the surface which has the effect of partially shrinking the loops subjected thereto.

In another variant implementation, the pre-treatment for reducing the height of the loops on the top face consists in heat treatment by radiation or by contact.

It will be understood that operating conditions both concerning singeing and concerning heat treatment must be determined in such a manner as to reduce the surface loops on the top face while not spoiling the other characteristics of the textile base material.

The emerizing or equivalent pre-treatment on the bottom face, i.e. the face of the textile base material which does not have a deposit of thermofusible polymer, serves to develop the loops and open up the tallest loops.

Preferably, the method of the invention consists in subjecting the textile base material initially to emerizing or equivalent pre-treatment on the bottom face and then to singeing pre-treatment on the top face.

BRIEF DESCRIPTION OF THE DRAWING

The present invention will be better understood on reading the following description of an implementation of the method of treating a textile base material for thermobonding interlining made up of threads texturized by means of jets of air, with emerizing pre-treatment on the face that is to receive spots of thermofusible polymer, and with singeing pre-treatment on the other face, as illustrated in the accompanying drawing, in which.

MORE DETAILED DESCRIPTION

Figure 1:
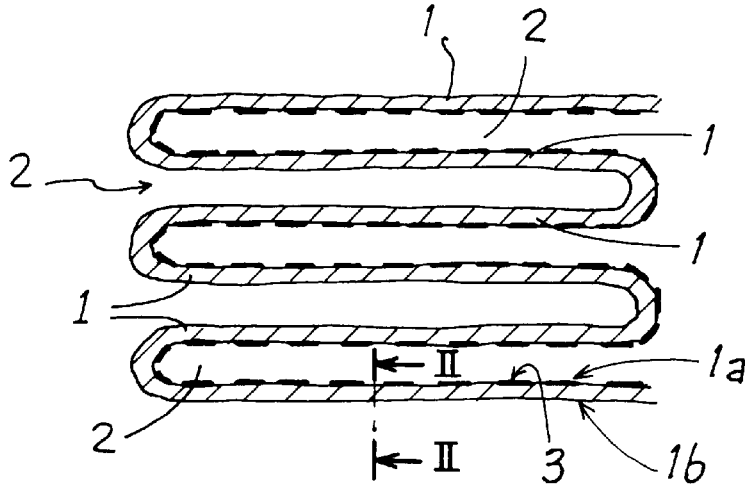
FIG. 1 is a diagrammatic section through a stack made up of superposed folds of a textile base material for thermobonding interlining.

When manufacturing garments, interlining pieces are taken by an operator from a stack of superposed pieces cut out to the required shape. The stack is obtained in a preceding operation starting from a wide interlining material which is laid up in the form of successive superposed folds, as shown in FIG. 1. For ease of understanding, gaps 2 are shown between adjacent folds 1, but such gaps naturally do not exist in reality.

Since the stack is made of thermobonding interlining, each fold 1 has spots 3 of thermofusible polymer on one of its faces 1*a*.

In the example shown in FIG. 1, because the stack is built up by forming successive folds, the face 1*a* of a given fold 1 that has spots 3 of polymer is always facing and in contact with the equivalent face 1*a* of an adjacent fold, i.e. a face that likewise has spots 3 of polymer. The same remark applies to the other face 1*b* that does not have spots of polymer, which face is always facing and in contact with the equivalent face 1*b* of an adjacent fold.

When thermobonding interlining is made from a textile base material which is a woven fabric or a weft knit made up using texturized synthetic threads, in particular using threads obtained by the air jet texturizing technique, the Applicant has observed that there is a risk of the interlining pieces making up the cut-out stack catching on one another. This constitutes a significant problem when manufacturing a garment, on each occasion that an operator needs to take an interlining piece from the stack. The piece can remain partially attached to the following piece which means that the operator needs to perform an additional action, thereby not only wasting time, but also causing the stack to be wrongly presented on the following occasion that a piece is to be taken therefrom.

The Applicant believes that these catching phenomena are analogous to those implemented deliberately in self-fastening mechanical closure systems of the kind known, in particular, under the name Velcro. In those systems, effective catching is obtained between two facing surfaces, one of which has hook or claw type elements while the other has interlaced loops such that catching arises by the hook or claw type elements catching in the loops. According to the Applicant, in the present case, the elements are not genuinely of the hook or claw type but they are constituted by loops projecting from the surface of the textile base material coming from the texturized synthetic threads and tangling with the loops of the layers that are superposed while the stack is being laid up, with said tangling being further accentuated during the operation of cutting up the stack.

Figure 2:
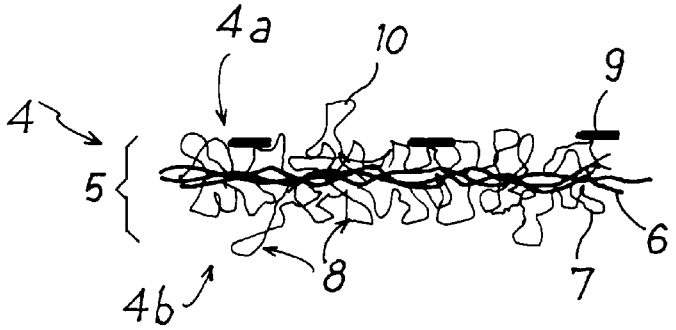
FIG. 2 is a section view through thermobonding interlining that has not been subjected to the treatment of the invention.

FIG. 2 shows a thermobonding interlining 4 made up of a woven fabric or a weft knit in which the weft (the only part shown in FIG. 2) is made up of texturized synthetic threads obtained by air jet texturizing. More precisely, these threads 5 comprise at least two multifilament threads 6, 7, namely a first thread known as a "core" thread 6 and a second thread known as an "effect" thread 7 which forms projecting loops 8 that extend a long way from the core thread 6 and that tangle with the filaments constituting said core thread 6.

The top face 4*a* in FIG. 2 of the interlining 4 has spots 9 of thermofusible polymer.

Amongst the loops 8 formed by the effect thread 7, there can be seen loops 10 that project further than the others from the face 4*a* carrying the spots 9 of polymer, and also from the other face 4*b*.

According to the Applicant, the catching phenomenon between two adjacent pieces of interlining in the cut-up stack is due to tangling between the loops 8, and in particular the more prominent loops 10 on the two facing faces 4*a* and 4*b* that are in contact with each other, however that does not exclude the presence of the spots 9 of thermofusible polymer also being an aggravating factor with respect to catching between two facing faces 4*a*.

Figure 3:
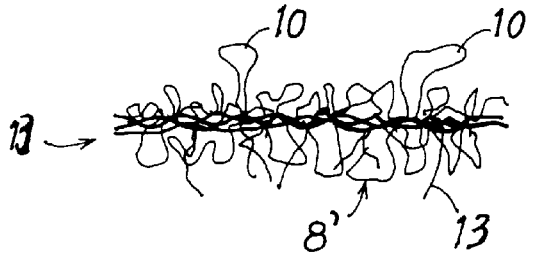
FIG. 3 is a diagrammatic section of a textile base material whose weft is made up of threads that are texturized by jets of air, after the material has been subjected to emerizing pre-treatment on one face.

To remedy that drawback, prior to the operation of depositing spots 9 of thermofusible polymer on the face 4*a*, the textile base material 13 is subjected to a first treatment which consists in emerizing the face 4*b* that is not going to receive spots 9 of thermofusible polymer. An emerizing operation, which is well known per se, consists in subjecting a textile article to the mechanical action of a rough surface such as an emery cloth. This action has the effect of changing the surface state of the article. In particular, when the article includes loops, as in the present case, emerizing develops the loops and can go as far as opening them by releasing the free ends of some of the loops from being held captive in the core thread 6, and sometimes even cutting them. As shown in FIG. 3, emerizing gives rise to loops 8" which are more open, and also to free ends 11.

The emerizing action is preferably sufficiently intense to ensure that the face 4*b* treated in this way has a structure that is close to that of a web of staple fibers. It can be performed, for example, on an emerizing machine designed for treating knitted fabric and fitted with multiple cylinders and tension control.

A face 4*b* having this configuration and pressed against another face having the same structure no longer gives rise to catching by loops tangling, which might otherwise be an impediment while separating two pieces of interlining on a cut-up stack.

This first treatment of the textile base material 13 is followed by a singeing second treatment applied to the face 4*a* that is to receive the spots 9 of polymer. The singeing technique is well known and consists in subjecting the surface of the textile article to the action of a flame while said article passes a strip of gas burners. Conventionally, this operation is intended to remove the surface fluff that is to be found on the surface of fabric.

Figure 4:
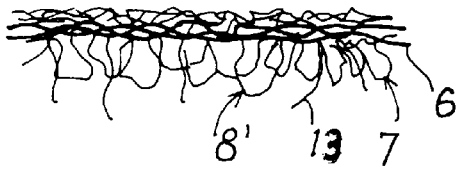
FIG. 4 is a diagrammatic section of the FIG. 3 textile base material after singeing pre-treatment has been applied to the other face.

In the present case, the looked-for effect of singeing consists in reducing the height of loops projecting from the face 4*a* of the textile base material 13, and in particular the height of the most prominent loops 10. Singeing parameters, in particular article displacement speed, height and temperature of the flames, . . . , are adjusted so that at least the most prominent loops 10 come into contact with the flame and are subjected to a thermal shock that is suitable for shrinking them. As shown in FIG. 4, a face 4*a* is thus obtained which is much more plane, regular, and uniform in height. This singeing operation does not significantly spoil the bulk of the textile base material 13 nor does it spoil its other characteristics. In particular, it is important for the thermal shock on the face 4*a* to be sufficiently superficial to avoid excessively melting the filaments that constitute the loops 8, since such melting would stiffen the textile base material 13. For this reason, the singeing installation must be fitted with means for accurately controlling the temperature of the flame, and preferably the travel speed of the material while singeing is taking place is at least 80 meters per minute (m/min).

Figure 5:
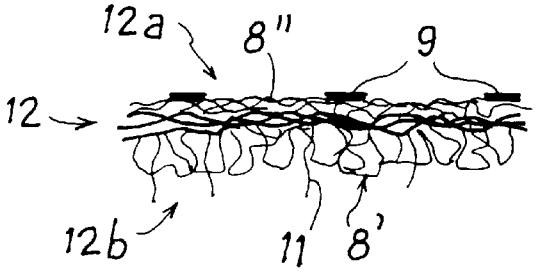
FIG. 5 shows the thermobonding interlining obtained by depositing spots of thermofusible polymer on the singed face of the FIG. 4 textile base material.

Once both treatments have been performed, the textile base material pre-treated in this way can be subjected to a conventional operation of depositing spots 9 of thermofusible polymer, so as to obtain the thermobonding interlining 12 shown in FIG. 5. The spots may be obtained from a powder, or from a paste, or indeed may be two-layer spots. In FIG. 5, it can be seen that the face 12*a* has spots 9 of thermofusible polymer, and loops 8' which are regular and of uniform height, while the other face 12*b* has larger loops 8" that are likewise regular, and filaments having free ends 11.

According to the Applicant, in this structure, the looked-for result is obtained, i.e. no significant catching occurs between facing and contacting faces of two successive pieces in a cut-out stack that could make it difficult to take hold of interlining pieces from the stack, and that this applies regardless of whether the faces concerned are faces 12*a* having spots 9 of polymer or the other faces 12*b*.

The present invention is not limited to the implementation described above by way of non-exhaustive example. In particular, the emerizing treatment may be replaced by an equivalent treatment, e.g. napping, i.e. mechanically brushing the surface of the material by means of cylinders lined with curved metal needles. Also, the singeing treatment could be replaced by an equivalent treatment, in particular heat treatment whether by means of radiation or by means of contact.

The method of the invention is particularly advantageous in the context of thermobonding interlining of the kind taught in document EP 578 527. Nevertheless, it can be advantageous for other types of interlining, constituted by texturized synthetic threads and suffering from the above-described catching phenomenon.

I claim:

1. A method of treating a textile base material for thermobonding interlining, comprising:

providing a textile base material, wherein the textile base material is a woven fabric or a weft knit and the textile base material has a top face and a bottom face, the textile base material including air jet texturized synthetic threads, the threads forming loops on the top face and on the bottom face of the textile base material, subjecting the bottom face of the textile base material to an emerizing treatment;

subjecting the top face of the textile base material to a pretreatment for reducing the height of the loops, and;

applying spots of glue to the top face of the textile base material.

2. The method of claim 1, wherein the pretreatment for reducing the height of the loops on the top face is a singeing treatment.

3. The method of claim 1, wherein the pre-treatment of reducing the height of the loops on the top face consists in heat treatment by radiation or by contact.

4. A method according to claim 1, wherein the bottom face is initially subjected to an emerizing treatment and then the top face of the textile base material is subjected to a pretreatment for reducing the height of the loops, the pre-treatment for reducing the height of the loops being a singeing pretreatment.

5. The method of claim 1, wherein emerizing the bottom face of the material and reducing the height of the loops on the top face of the material prevent the top and bottom sides from catching when facing each other.

6. A method comprising:

providing a textile base material formed from texturized synthetic threads, the threads forming loops extending from a first side and a second side;

emerizing the first side of the material and reducing the height of the loops on the second side of the material to prevent the first and second sides from catching when facing each other; and applying spots of thermoplastic polymer on the second side of the material.

7. A method according to claim 6, wherein the height of the loops is reduced by a singeing treatment.

8. A method according to claim 6, wherein the height of the loops is reduced by a heat treatment.

9. A method according to claim 8, wherein the heat treatment is a radiation heat treatment.

10. A method according to claim 8, wherein the heat treatment is a contact heat treatment.

11. A method according to claim 6, wherein the threads are texturized by an air jet texturizing technique.

12. A method according to claim 11, wherein the height of the loops is reduced by a singeing treatment.

13. A method according to claim 11, wherein the height of the loops is reduced by a heat treatment.

14. A method according to claim 13, wherein the heat treatment is a radiation heat treatment.

15. A method according to claim 13, wherein the heat treatment is a contact heat treatment.

* * * * *